US005404892A

United States Patent [19]

Bretl

[11] Patent Number: 5,404,892

[45] Date of Patent: Apr. 11, 1995

[54] APPARATUS AND METHOD FOR DECORATING HAIR

[76] Inventor: Sue K. Bretl, 1202 Green Grove Rd., Appleton, Wis. 54911

[21] Appl. No.: 197,735

[22] Filed: Feb. 17, 1994

[51] Int. Cl.[6] ..... A45D 8/34

[52] U.S. Cl. ..... 132/200; 132/212; 132/275

[58] Field of Search ..... 132/53, 54, 200, 201, 132/212, 275; 29/241, 443; 223/48

[56] References Cited

U.S. PATENT DOCUMENTS

| | | | |
|---|---|---|---|
| 2,865,380 | 12/1958 | Mitchell | 132/201 |
| 4,307,908 | 12/1981 | Donaldson | 132/200 |
| 4,315,362 | 2/1982 | Pigford et al. | 29/433 |
| 4,783,974 | 11/1988 | Hernandez . | |
| 4,892,110 | 1/1990 | Harvie . | |
| 5,097,854 | 3/1992 | Smith . | |
| 5,107,867 | 4/1992 | Berrington | 132/201 |
| 5,167,245 | 12/1992 | Harriett | 132/200 |

FOREIGN PATENT DOCUMENTS

| | | | |
|---|---|---|---|
| 0438986 | 7/1991 | European Pat. Off. | 132/201 |

*Primary Examiner*—John G. Weiss
*Attorney, Agent, or Firm*—Ryan, Kees & Hohenfeldt

[57] ABSTRACT

An apparatus and a method for ornamenting hair. A portion of hair is selected to be decorated. A portion of the length of each of a plurality of floss threads is then braided into the selected portion of hair, thereby forming a base cord. An adhesive is applied to the outside surface of the base cord. Then the balance of each floss thread is tied and wrapped about the base cord and adhesive. One thread at a time is wrapped and tied, for a number of loops, with the other threads being included inside the wrapping and loops for that number of loops. This tying and wrapping is continued until a desired length, changing which thread is being looped and tied after every predetermined number of loops. Optionally, beads and/or rondles, or other decorations, may be applied to the base cord and threads among the loops. Once the floss threads are looped and tied to the desired length, all of the ends of the floss threads are tied into a single knot. Any threads then extending beyond the single knot are then cut off. A lobster claw assembly is then clamped onto the knot, and a decorative extension is removably attached to the lobster claw.

14 Claims, 2 Drawing Sheets

APPARATUS AND METHOD FOR DECORATING HAIR

BACKGROUND OF THE INVENTION

This invention relates to methods and devices for decorating hair by tying and wrapping, and in particular to methods and devices for making the decorations easily changeable, replaceable and removable.

Hair wrapping per se may be considered an old art. Historically, tribes used hair wraps for ceremonial purposes. Today, hair wraps may be used to make individual fashion statements. Traditionally, however, professional persons and persons who wanted flexibility in their hair fashions were not able to take full advantage of hair wraps. The reason is that a conventional hair wrap is applied to hair in a substantially permanent manner, and the only practical way to remove the conventional hair wrap is to cut the hair to which the wrap is attached.

This invention relates to improvements to the methods and apparatus described above, and to solutions to some of the problems raised or not solved thereby.

SUMMARY OF THE INVENTION

The invention relates to an apparatus and a method for ornamenting hair. According to the invention, a portion of hair is selected to which ornamentation is to be attached. That portion of hair may be pinned together, thereby separated from the other hair not to be wrapped. A portion of the length of each of a plurality of floss threads is then braided into the selected portion of hair. The balance of each floss thread is held out of the braid. An adhesive is applied to the outside surface of the braid, thereby forming a base cord. Then the balance of each floss thread is tied and wrapped about the base cord to form a top wrap. One thread at a time is wrapped and tied, for a number of loops, with the other threads being included with the base cord inside the top wrap for that number of loops. This tying and wrapping of the top wrap is continued until a desired length is reached, periodically changing the selected thread being looped and tied after every predetermined number of loops. Optionally, beads and/or rondles, or other decorations, may be applied to the top wrap among the loops. Once the floss threads are wrapped to the desired length, all of the ends of the floss threads are tied into a single knot. Any threads then extending beyond the single knot may then be cut off, and adhesive applied over the cut ends of the threads to reduce fraying. An assembly, including a cap, a ring, and a lobster claw, is then clamped onto the knot, so that a substantially permanent attachment is achieved. A decorative extension is then removably attached to the lobster claw. The cap of the lobster claw assembly to be attached to the knot includes a number of petals, which may be bent over to substantially permanently enclose the knot therein.

Other objects and advantages of the invention will become apparent hereinafter.

DESCRIPTION OF THE PREFERRED EMBODIMENT

Figure 1:
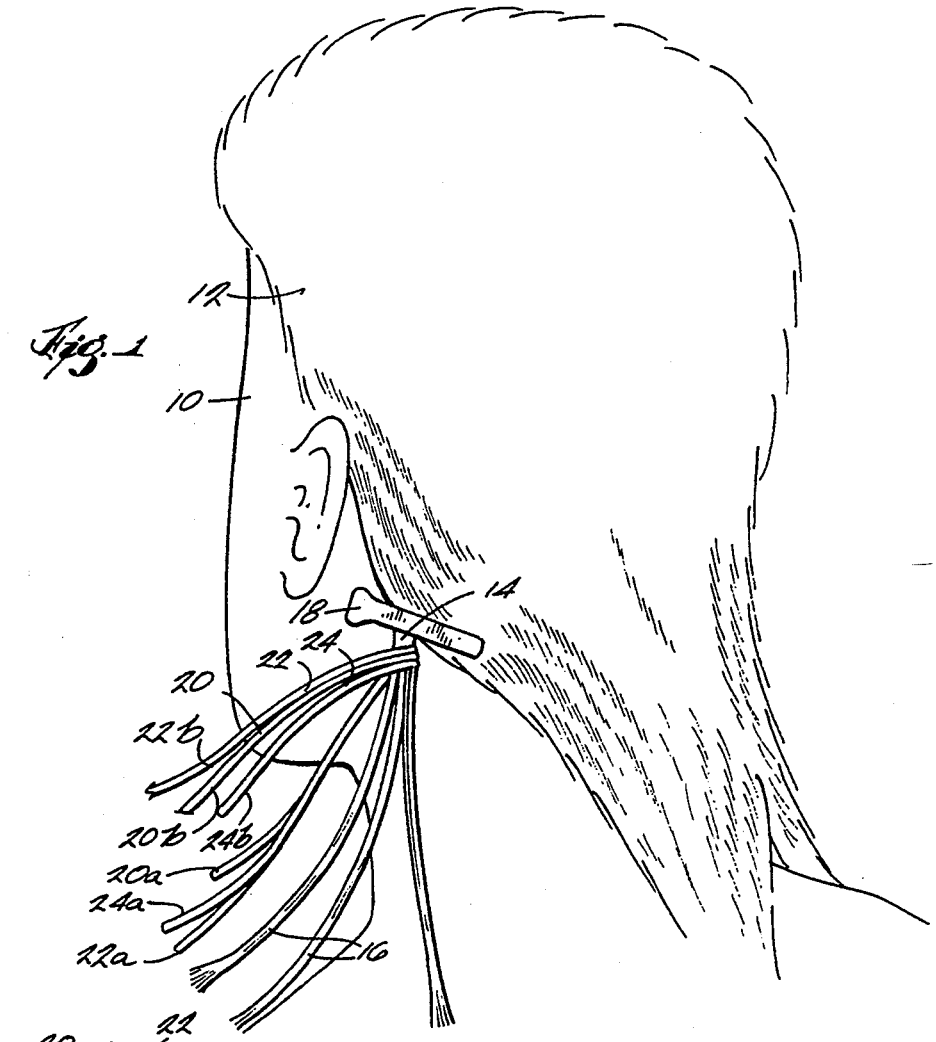
FIG. 1 is a perspective view of a person's hair, with a portion of hair selected, pinned apart, and joined to selected portions of the floss thread, which is the first step according to the method of the invention.
Figure 2:
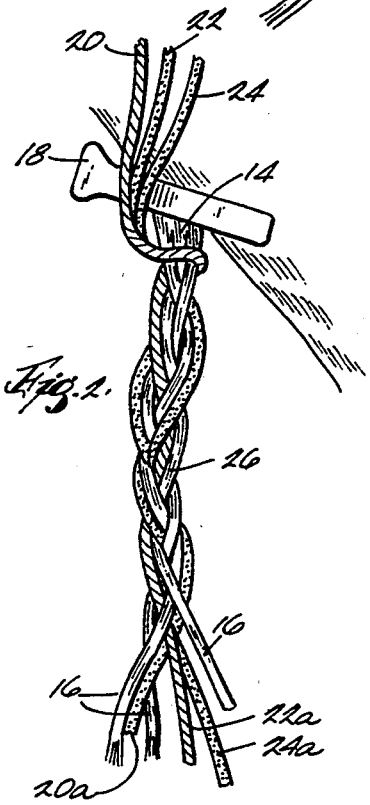
FIGS. 2 through 9 are perspective views of the wrap, showing successive steps of a preferred embodiment of the method of the invention, using apparatus according to a preferred embodiment of the invention.
Figure 3:
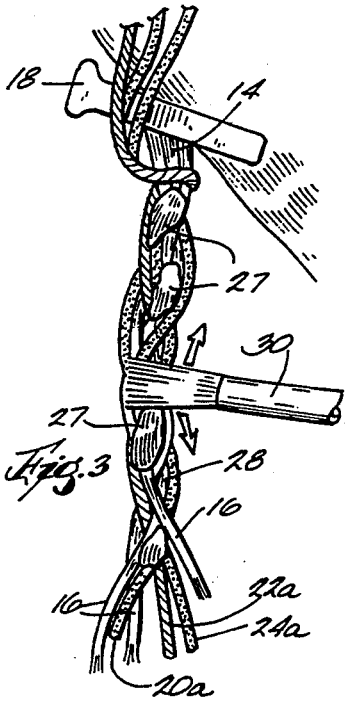

Referring now to FIG. 1, there is shown a person 10 having a certain amount and length of hair 12. A selected portion 14 of hair 12, designated to be included according to the invention, is shown separated from the rest of the hair, and further subdivided into three strands 16, each strand formed by a number of hairs. Applicant has found that a dime-sized area of hair may be most preferable as the selected hair portion 14. As shown in FIGS. 1 through 3, the selected hair portion 14 may then be separated from the rest of the person's hair 12, and held together, by any suitable means, such as a hairpin 18. The rest of the person's hair 12 should be held out of the way by any suitable means, such as hairpins (not shown) or styling mousse.

A number of floss threads 20, 22, 24, selected to be combined with the hair strands 16 because of the color or design of the floss threads, are held in place near the root area of the selected portion of hair 14. A portion **20*a*, 22*a*, 24*a* of each of the floss threads 20, 22, 24, is arranged to lie along the strands 16, the length of those portions arranged so as to be substantially co-extensive with the strands. The balance 20*b*, 22*b*, 24*b*, of each of the threads is temporarily held completely away from the selected hair portion 14. As will be seen presently, the preferable number of floss threads 20, 22, 24** is three.

The hair strands 16, and the thread portions **20*a*, 22*a*, 24*a* that are arranged to lie along the strands, are then braided together to form a braid 26, as shown in FIG. 2**, each one of the thread portions being combined with one of the strands for braiding. This is the reason that the preferred number of floss threads is three. If there are more or less floss threads than hair strands, then some of the threads will have to be doubled up with one of the hair strands, or vice versa, when braided.

After the hair strands 16 and thread portions **20*a*, 22*a* and 24*a* are braided throughout their length, the bottom of the finished braid is temporarily held together. A suitable bonding adhesive 27, such as a wig-bonding adhesive, is then applied to the outside surface of the braid 26, as shown in FIG. 3, thereby forming a base cord 28. Adhesive 27 may be applied by any suitable means, such as a brush 30**.

Figure 4:
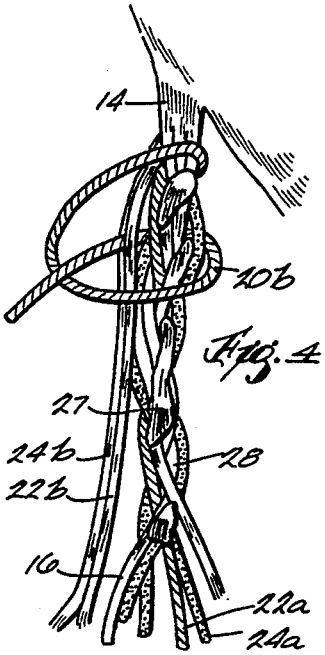
Figure 5:
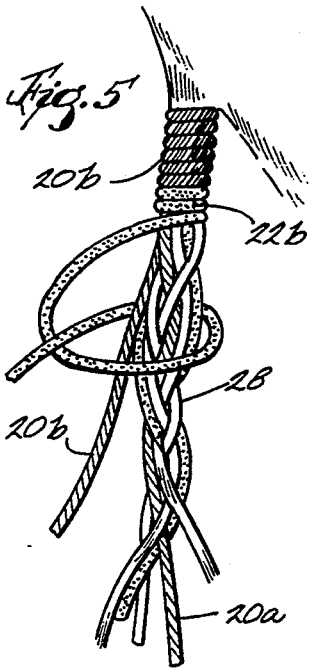

Balance portions **20*b*, 22*b*, 24*b* of the floss threads 20, 22, 24 are thus temporarily left to extend loosely from the top of the base cord. At this point, one balance portion 20*b* is selected from the three, the other balance portions 22*b*, 24*b*, being aligned along the base cord 28. As shown in FIG. 4, the chosen balance portion 20*b* is then looped around the base cord and other balance portions and a knot is tied, preferably a half-hitch. As shown in FIG. 5, the selected balance portion 20*b* is looped and tied in this manner a predetermined number of times, such as five to seven times. At that point a different balance portion 22*b* is selected, and the original balance portion 20*b* is now recombined with the base cord 28. The second balance portion 22*b* is then looped and tied in the same manner as was the first balance portion 20*b*, for a predetermined number of loops. Then the third balance portion 24*b* is selected, and the second balance portion 22*b* is recombined with the base cord 28**, in the same manner. This looping and tying of the selected balance portion around the base cord 28, and periodically changing balance portions, results in a "top wrap" 31. The looping and tying is continued until a suitable length of top wrap is reached, as shown in FIG. 6.

Figure 6:
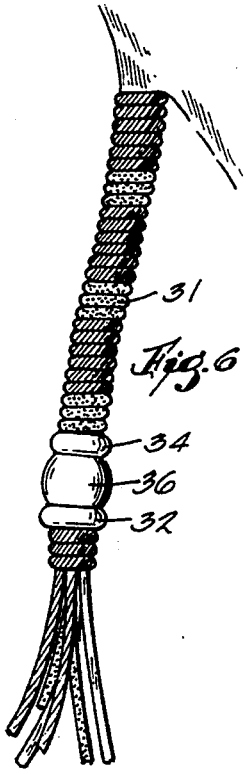

Along the way, as also shown in FIG. 6, various hair decorations may be installed onto the base cord 28, with the looping and tying continued thereafter. In the embodiment shown in FIG. 6, two beads 32, 34 are slid onto the base cord 28, separated by a rondle 36, and there are several loops and knots formed thereafter in the floss threads.

Figure 7:
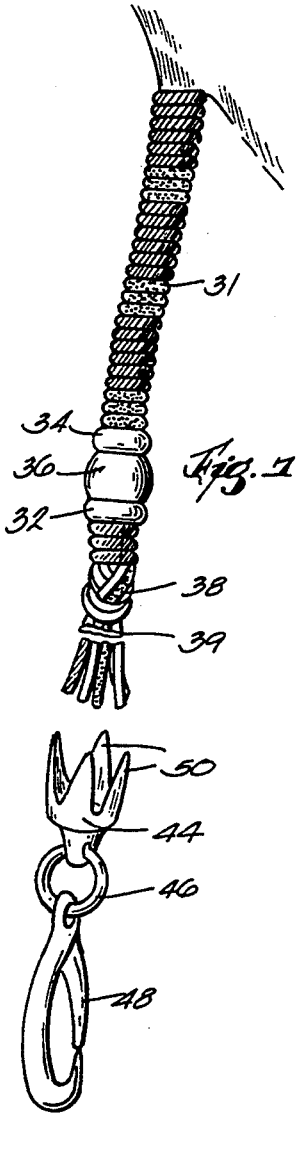

When a desired length of top wrap 31 is reached, the entire combination of base cord and floss threads not yet included in the top wrap is tied in a single knot 38, as shown in FIG. 7. Any hair ends 40 and thread ends 42 that extend beyond the knot 38 are cut off. At this point additional adhesive 39, such as a suitable craft adhesive, may be applied to the cut ends of the hair strands 16 and threads 20, 22 and 24 that may still extend just slightly beyond the knot 38, to reduce the possibility of fraying.

Figure 8:
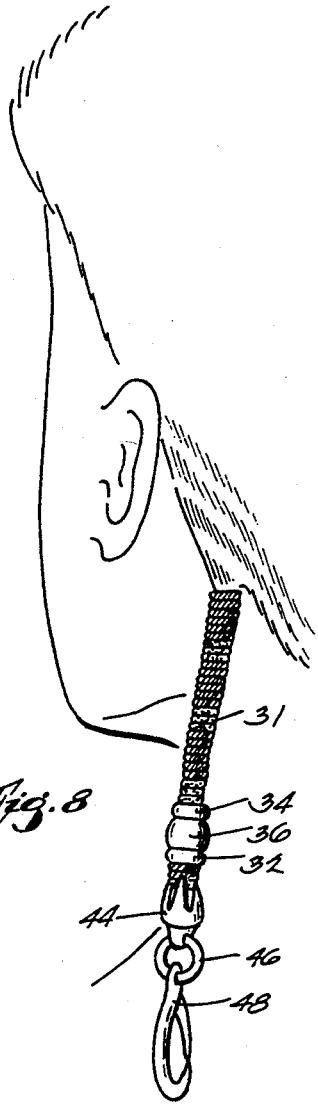
Figure 9:
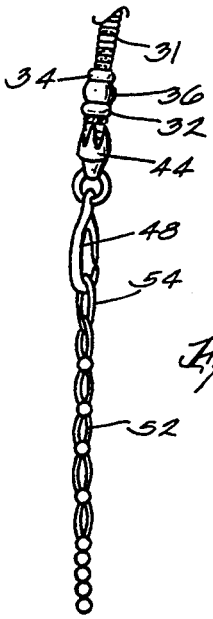

As also shown in FIG. 7, cap 44 is then applied to the knot 38, the cap having previously been attached to a ring 46, which in turn is connected to a "lobster claw" 48, which is a reclosable hook device. According to the invention, the cap 44 is made of metal, and has petals 50 which are bendable toward each other. As can be seen in FIG. 8, the cap 44 is applied to the knot 38 by bending the petals 50 inward tightly around the knot. A substantially permanent attachment of the cap 44 to the top wrap 31 is thus achieved.

With the lobster claw 48 now attached to the end of the top wrap 31 by means of the cap 44 and ring 46, any number of decorative extensions 52, comprised of floss threads, beads, rondles, stones and so on, may be attached to the top wrap. The attachment is made by hooking the end of the extension 52, by means of a loop in the threads or by a ring 54 connected into the extension for that purpose, to the lobster claw 48.

Thus, by providing a relatively short top wrap that is inconspicuous, in fact almost invisible, when the extension is not attached, but with means for easily attaching a longer and more prominent hair decoration, the invention provides an easy way for a person to alternate between the attachment of long hair decorations, such as for evening wear, and the removal of those decorations, such as for daytime wear in an office.

While the apparatus hereinbefore described is effectively adapted to fulfill the aforesaid objects, it is to be understood that the invention is not intended to be limited to the specific preferred embodiment of apparatus and method for decorating hair set forth above. Rather, it is to be taken as including all reasonable equivalents to the subject matter of the appended claims.

I claim:

1. A kit for ornamenting hair, comprising:

a plurality of floss threads, each floss thread having a first portion and a balance portion, the first portion of each floss thread adapted to being braided into a selected portion of the hair, by which would be formed a braid, the balance portion of each floss thread not braided into the selected portion of the hair;

adhesive adapted to be applied to the braid by which would be formed a base cord, at least a portion of the balance portion of each of the floss threads adapted to being tied and wrapped around the base cord, the ends of the floss threads then capable of being tied in a single knot;

a ring;

a cap and a lobster claw adapted to be attached to the ring, wherein the cap would be securely and substantially permanently attachable to the knot; and a decorative extension removably attachable to the lobster claw.

2. A kit as recited in claim 1 wherein any floss threads extending beyond the knot are adapted to be cut off, portions of the threads not being cut off then adapted to have cut ends, and further comprising adhesive adapted to be applied to the cut ends of the floss threads, for the purpose of reducing fraying.

3. A kit as recited in claim 1 wherein the cap includes petals which are securely and substantially permanently closeable on the knot.

4. A kit as recited in claim 2 wherein the adhesive adapted to be applied to the external surface of the braid is a wig-bonding adhesive and the adhesive adapted to be applied to the cut ends is a craft adhesive.

5. A kit as recited in claim 3 wherein the petals of the cap are bendable and thereby closeable on the knot.

6. A kit as recited in claim 1 further comprising decorations adapted to be applied to the base cord before the ends of the floss thread are tied in the single knot.

7. A kit as recited in claim 6 wherein said decorations include beads and rondles.

8. A method for ornamenting hair, comprising:

selecting a portion of hair to which ornamentation is to be attached;

braiding into the selected portion of hair a portion of each of a plurality of floss threads, thereby forming a braid, and saving the balance of each floss thread from being braided into the selected portion of hair;

applying adhesive to the braid, to form a base cord; tying and wrapping the balance of each floss thread about the base cord;

tying all of the ends of the floss threads into a single knot;

applying a cap-ring-lobster-claw assembly to the knot;

attaching a decorative extension to the lobster claw.

9. A method as recited in claim 8 wherein the selected portion of hair, once selected, is pinned together until the step of applying adhesive.

10. A method as recited in claim 8 wherein, when tying and wrapping the floss thread about the base cord, the floss threads not being tied are simply included inside the wrap along with the base cord.

11. A method as recited in claim 8 further comprising, while tying and wrapping the floss threads about the base cord, applying decorations to the base cord and floss threads.

12. A method as recited in claim 8 further comprising, after the second tying step, the step of cutting off the ends of any floss threads that extend beyond the knot.

13. A method as recited in claim 12, further comprising the step of applying adhesive to the cut off ends of the floss threads, before applying the cap-ring-lobster-claw assembly.

14. A method as recited in claim 8 wherein the step of applying the cap-ring-lobster-claw assembly to the knot includes bending petals of the cap so that the cap is securely clamped onto the knot.

* * * * *